United States Patent [19]

Schwab, Jr.

[11] Patent Number: 4,850,122

[45] Date of Patent: Jul. 25, 1989

[54] SHOE COVER

[76] Inventor: Robert L. Schwab, Jr., 8137 W. Tripoli Ave., Milwaukee, Wis. 53220

[21] Appl. No.: 202,337

[22] Filed: Jun. 6, 1988

[51] Int. Cl.[4] ..... A43B 13/22

[52] U.S. Cl. ..... 36/72 R; 36/7.1 R; 36/7.2; 36/100

[58] Field of Search ..... 36/7.1 R, 7.2, 72 R, 36/100, 101

[56] References Cited

U.S. PATENT DOCUMENTS 2,078,732 4/1937 Palmer ..... 36/72 R 4,538,368 9/1985 Mugford ..... 36/7.1 R

*Primary Examiner*—Werner H. Schroeder

*Assistant Examiner*—D. Biefeld

*Attorney, Agent, or Firm*—Wheeler Law Firm

[57] ABSTRACT

A shoe cover comprises a pouch which is closed with the exception of an opening at the area of the shoe heel. The pouch has two lobes, one covering the outside of the shoe and one covering the inside of the shoe when the shoe cover is installed and the shoe is worn, to provide a swift and easy change in shoe appearance without the necessity of carrying multiple pairs of shoes, and top provide protection for the shoes, or against contamination.

12 Claims, 3 Drawing Sheets

SHOE COVER

BACKGROUND OF THE INVENTION

This invention is designed to make it easy and convenient for shoes to be covered in a manner that changes their color, protects them, and which provides a clean surface, without requiring a shoe of every different color. This shoe cover is small, light and convenient.

SUMMARY OF THE INVENTION

The invention consists of a single pouch having two lobes. One lobe covers the outside of the shoe and the other lines the inside of the shoe forming a sock liner which has a smooth surface even if the inside of the shoe does not, is comfortable, and holds the lobe which covers the outside of the shore smoothly in place. The only opening in the preferred form of the invention is the area surrounding the heel of the shoe. This opening allows the toe of the shoe to be inserted into the lobe intended for it, with the remainder of the pouch being pulled over the shoe upper to cover the heel portion or area of the upper so that the opening of the pouch surrounds any heel that the shoe may have.

The application shows two designs which are illustrative of the forms that the inventions may take. The form of FIGS. 3, 4 and 8 is made of two pieces of fabric, preferably stretch fabric, with the seams so arranged that when the cover is installed on a shoe and the wearer is wearing the shoe, the only visible seam is at the back of the heel portion of the upper. However the same seam continues along the inner surface of the heel portion of the upper and along the center line of the sole to an area of the inner surface of the sole where the instep of the user is located. The seam then loops around the foot of the user, extending upwardly and forwardly to an area of the inner lobe just within the margin of the shoe upper at the front. The seam then extends downwardly and rearwardly to the instep where it rejoins the seam previously described, so that that portion of the seam is a closed loop. At the point where the seam is at its upper-most and forward-most position a short additional seam extends toward the toe of the shoe along the inner surface of the shoe upper. These seams are so arranged that when the wearer has the cover on the shoe and the shoe on the foot, the seams are all within the shoe against the inner surface, with the exception of the portion of the seam that follows the back of the heel portion of the upper. That portion follows a line where the upper itself normally has a seam and is not at all obvious. The only remaining seam in this version of applicant's invention is a seam along the mid-line of the sole of the shoe outside the shoe extending from the opening around the shoe heel to the toe of the shoe, and entirely hidden by the shoe when the shoe is on the ground. The seams described are quite comfortable for the wearer and with the exception of the seam outside the heel portion of the upper are completely unseen under normal circumstances.

The other version of the invention shown at FIGS. 5, 6 and 7 uses a single fabric blank from which the entire bi-lobed pouch is formed. Because the pouch is formed of a single piece there are more seams and they are more visible although they are still not intrusive. One seam extends from the opening for the heel along the heel portion of the upper on the outside surface and down the inside surface to the place where the heel of the wearer of the shoe normally rests. Another seam extends from the opening around the heel forwardly generally along the mid-line of the shoe sole on the outside, around the tow, and on the mid-line of the upper past the most forward point of the opening in the shoe upper for the foot of the wearer, along the inside surface of the upper past the toe of the shoe and to an area under the toe of the wearer. This version has one more visible seam than the other version, but fewer seams on the inside surface of the shoe, and may be more comfortable for some wearers.

One other difference between the versions of my shoe cover is that the one-piece version must necessarily have a uniform color or pattern unless the initial form or blank is assembled of multiple pieces. Furthermore, the location of the blank with respect to the pattern may be quite important where there is a pattern. In the two-piece version shown, because the only visible seam is at the heel, the layout of the pattern on the fabric is less critical even where the fabric is patterned. It would be possible in either embodiment, to produce multi-colored or multi-pattern shoe covers by introducing additional pieces and seams, and these would be within my invention if they are within the claims which follow.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from theinvention, which is defined by the claims.

Figure 2:
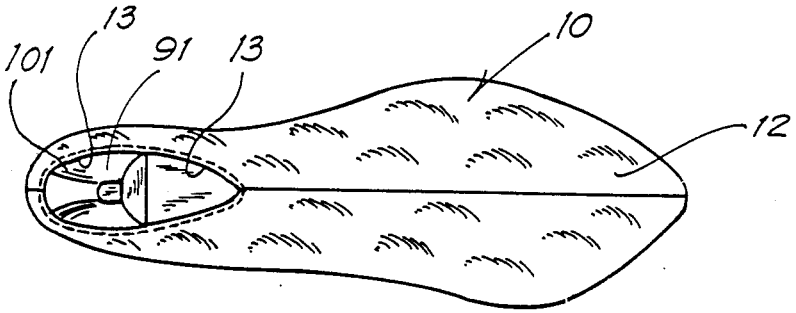
FIG. 2 is a bottom plan view of the shoe and shoe cover of FIG. 1.
Figure 1:
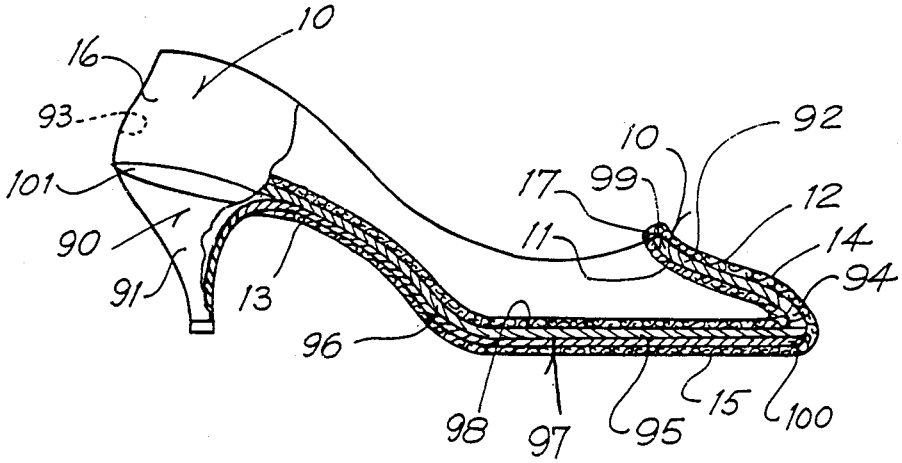
FIG. 1 is a side elevational view of a shoe on which the shoe cover of this invention is mounted, both the shoe and the shoe cover being cut away to show the parts more clearly.

As shown in FIGS. 1 and 2, the shoe cover of this invention is worn over a shoe 90. For purposes of illustration the shoe is lady's shoe and the invention has particular application to a lady's shoe because of the need to match women's costumes quite closely. That need creates a corresponding need to carry a great deal of luggage where the woman in question happens to be a model, who may be expected to have shoes to match a wide variety of clothing, or a traveler who may be carrying a wide variety of clothing. However the invention also has application to men. In addition to the uses mentioned the invention serves a protective function by keeping shoes polished and free of scuffing, and in some circumstances by preventing dirt from reaching the shoe. The shoe cover of the invention may also be used for covering the foot wear of persons about to enter a "clean room" in which the persons who enter must be covered with garments that can not allow dirt to escape to the work area of the clean room.

As illustrated in FIGS. 1 and 2 a show 90 has a heel 91, an upper 92, and a sole 95. Shoe upper 92 has a heel portion or area 93, a toe portion or area 94, and a margin 99 around the opening for the foot of the wearer. The sole 95 has an instep portion or area 96, between the toe end or area 100, and the heel end or area 101. The outer surface of the shoe as a whole is designated 97 and the inner surface of the shoe as a whole is designated 98.

The shoe cover of this invention is constructed to cover the entire outer surface 97 of shoe 90 with the exception of heel 91 and the entire inner surface 98 of shoe 90. Because of the stretch of the fabric and the differences between various shoes, the cover 10 may not enclose all of outer surface 97 around the heel 91.

Figure 3:
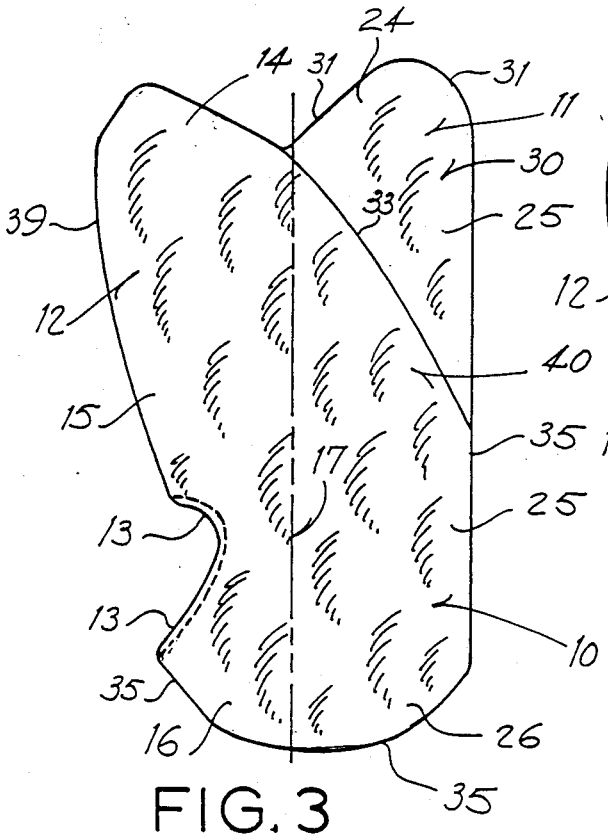
FIG. 3 is a side view of one embodiment of the shoe cover of my invention showing the shoe cover constructed from a two piece blank.
Figure 4:
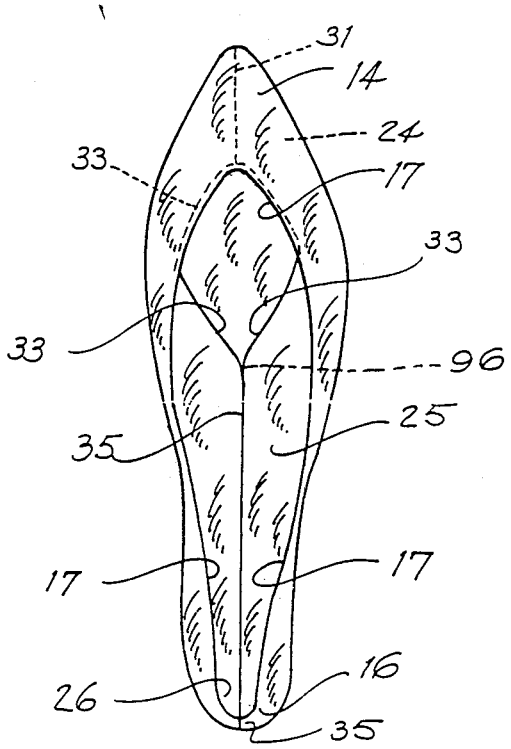
FIG. 4 is a top plan view of a shoe on which the shoe cover of FIG. 3 is installed.
Figure 8:
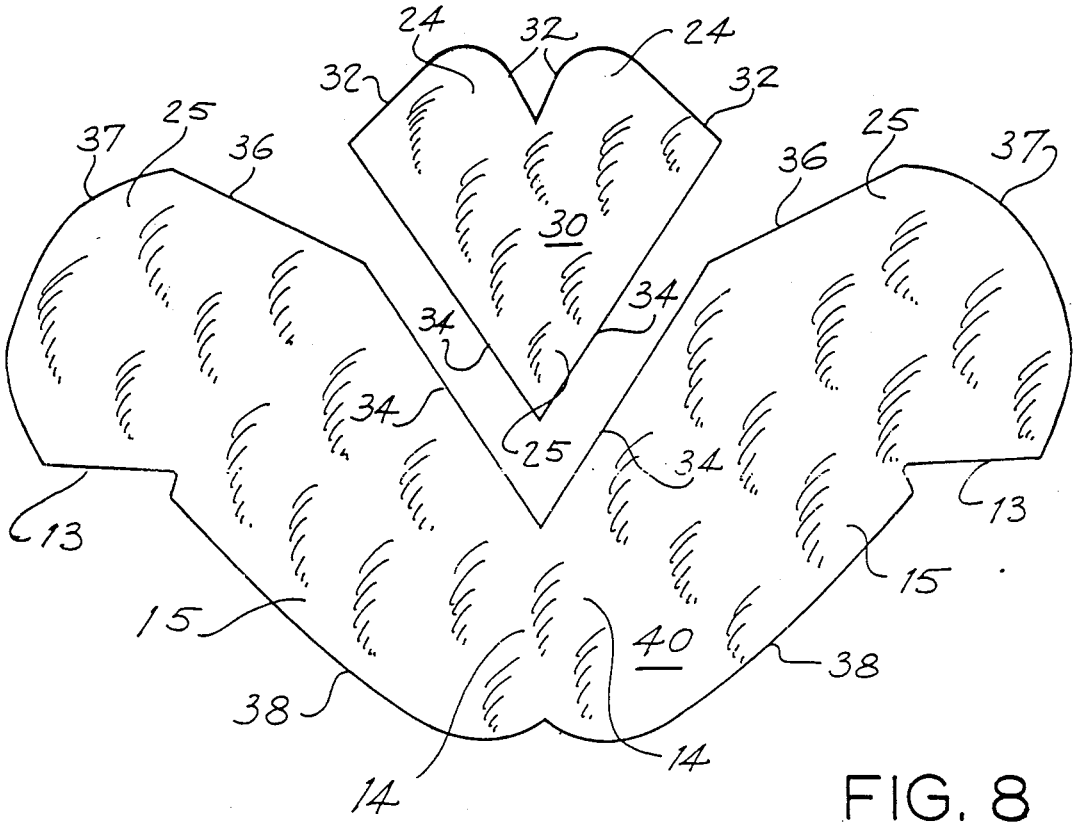
FIG. 8 is a top plan view of the two piece blank for the shoe cover of FIGS. 3 and 4.

FIGS. 3 and 4 show one form of the shoe cover of my invention and FIG. 8 shows the blank which is cut from a piece of material such as stretch fabric or other appropriate material to form the pouch 10 shown in FIGS. 3 and 4.

As shown in FIG. 3 the pouch 10 is divided generally along a mid-line shown by a dashed line 17 into a first lobe 11 which lines the inside surface 98 of the shoe 90 and a lob 12 which covers the exterior surface 97 of the shoe. Dealing first with the second lobe 12, that lobe has an area 14 which covers the toe portion 94 of the shoe upper. Sole area 15 of the pouch 10 covers the outside of the sole 95 of the shoe, from the toe area 100 to the heel area 101, but contains the opening bounded by edge 13 which extends completely around heel 91 when the cover 10 is on a shoe 90. Area 16 of pouch 10 covers the outside of heel area 93 of the shoe upper. Dashed line 17 generally shows the mid-line between lobe 11 and lobe 12 of pouch 10 but also is generally the area which covers margin 99, the free edge of the shoe upper which defines the opening into which a user places his or her foot. Line 17 thus becomes an edge as shown in FIG. 4 which generally corresponds with edge 99 shown in FIG. 1.

Inside the shoe when the cover is installed, area 24 lines the toe area 94, area 25 lines the sole area 95, and area 26 lines the heel area 93.

The shoe cover 10 is formed from flat pieces of material. The embodiment of FIGS. 3 and 4 requires two blanks 30 and 40 formed generally as shown in FIG. 8. Blank 30 forms the area extending from the instep portion 96 of sole 95 forwardly and includes portions of inside sole area 25 and inside toe area 24 as best shown in FIG. 3. A seam 31 (FIG. 3) joins edges 32. A second seam 33 (FIG. 3) which is a continuous loop joins edges 34 and from it seam 35 extends rearwardly from the instep area 96 of sole 95 and the junction where the loop of seam 33 is closed, generally along the mid-line of the inside of the shoe 90 all the way to the rear of sole portion 25 of lobe 11, up the mid-line of the inner heel portion 26, around edge 17 and down the mid-line of the outer area 16 covering heel portion 93, to edge 13 at heel 91 of shoe 90. Seam 35 joins edges 36, respectively, and then edges 37 respectively. Edges 13 on either side of blank 40 are not at a seam but the edges may be bound if desirable. Edges 38 are joined by seam 39.

Figure 5:
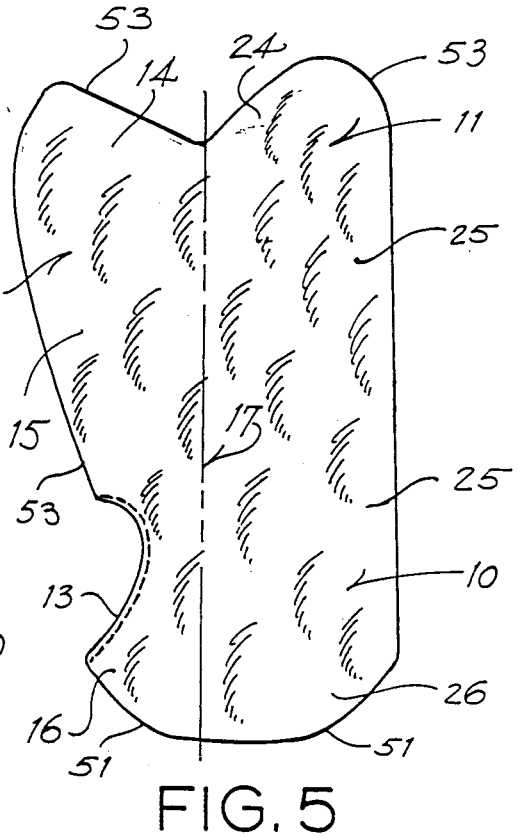
FIG. 5 is a side view of another embodiment of a shoe cover of my invention made from a one piece blank.
Figure 6:
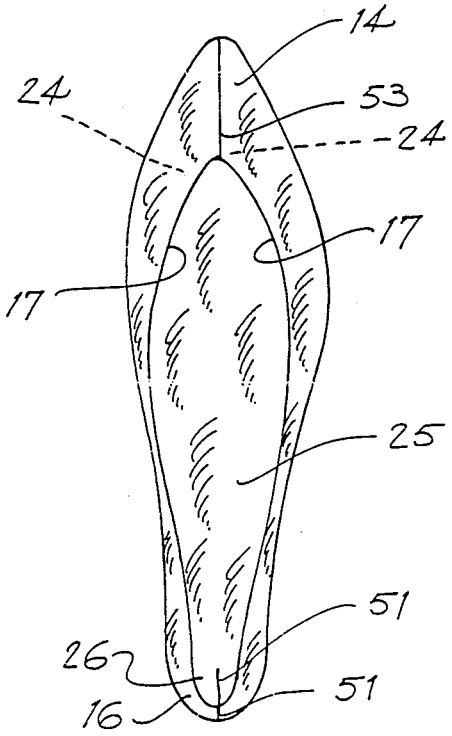
FIG. 6 is a top plan view of a shoe on which the shoe cover of FIG. 5 is installed.
Figure 7:
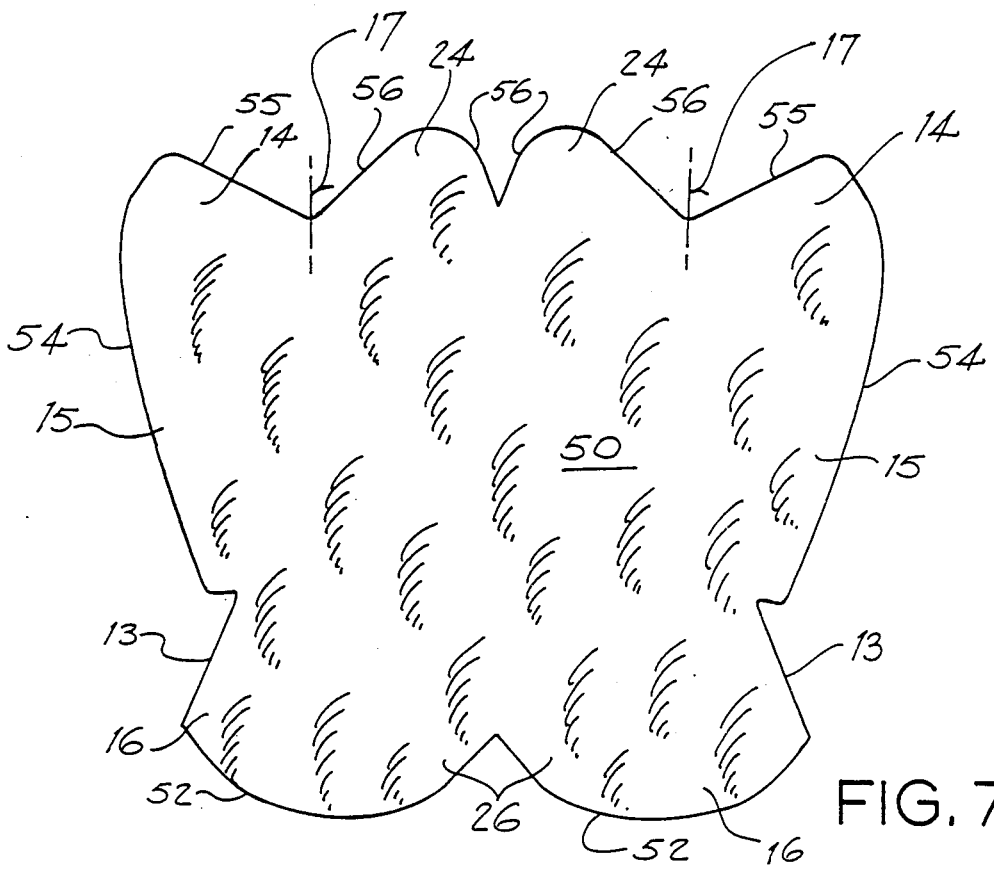
FIG. 7 is a top plan view of the one piece blank for the shoe cover of FIGS. 5 and 6.

The shoe cover shown in FIGS. 5, 6 and 7 differs only in details from the shoe cover shown in FIGS. 3, 4 and 8. The difference is that a single blank 50 is used to form the entire shoe cover 10. Two edges 13 outline the heel 91 of shoe 90. There is no seam, but the edges 13 may be bound if appropriate. A seam 51 (FIG. 5) joins edges 52 and extends along the mid-lines of regions 16 on the outer surface of heel portion 93 of the upper of shoe 90 and region 26 on the inner surface of heel portion 93 of upper 92 of shoe 90. Seam 53 extends all the way along sole 95 from margin 13 around heel 91 along the mid-line of the sole to toe area 100, along the mid-line of toe portion 94 of upper 92, across imaginary line 17 joining lobe 11 to lobe 12 (which generally follows edge 99 of the opening in upper 92 for the wearer's foot) down the mid-line of area 24 which lines toe area 94 of upper 92, to approximately the point where sole 95 joins upper 92. In FIG. 7 this seam joins edges 54 and 55 generally at the center of sole area 15 and toe area 14 on the outside and then joins edges 56 down the mid-line of area 24 which lines the toe area on the inside of shoe 90. Imaginary line 17 shown on FIG. 5, which becomes edge 17 on FIG. 6, crosses the blank between edges 55 and 56.

The blank for the shoe cover of this invention could take other forms, especially if it is desired to achieve a multi-color or multi-pattern effect. The blank could be divided to use material of different colors or patterns in different areas.

Where the effect desired is decorative rather than protective the blank or pattern for the fabric to form the shoe cover may have openings in it to expose the shoe beneath for contrast. Openings may also be made by leaving parts of the seam open, particularly seam 53 which extends along the top of toe area 14 in FIG. 6. It would be possible to form edge 55 on each side of FIG. 7 in a scalloped, pointed, or wavy form with seam 53 being replaced by tacking at the outer most points to produce an opening or a row of openings for decoration.

Desirably the material of which the shoe cover is made is a stretchable fabric. This offers a number of advantages. The shoe cover may be produced in one or a few basic sizes to fit most shoes. This applies not only to differences in shoe size but to differences in shoe shape as well. In both modifications shown, the seams are balanced from side to side and by using a stretch fabric minor adjustments in the position of the seams may be made easily to achieve a pleasing result where the purpose is decorative or to achieve a comfortable result regardless of the purpose. Where the purpose is decorative, a model or a traveller can readily carry a dozen sets of shoe covers in less space than is required for a single pair of shoes. Where the purpose is to match a particular costume the shoe cover may be made of the same fabric as the costume for a perfect match. If the material of which the shoe cover is made is not resilient or is not fabric, slight adjustments may be made in the contour of the blank to match the contours of a particular shoe style. In many cases nonresilient fabric can be cut on the bias to achieve a resilient effect. Other possibilities will be apparent from this disclosure and the scope of my invention is limited only by the attached claims.

In using the pouch of this invention, a shoe 90 is placed toe first through the opening bounded by margin 13 until the shoe is fully within the second lobe 12 of pouch 10, with margin 13 around heel 91 of the shoe. Lobe 11 is then pushed into the shoe to line the inside of the shoe, and the foot of the wearer of the shoe is inserted into the opening defined by edge 99, which now is covered by the part of the pouch generally defined by imaginary line 17. The insertion of the foot into the shoe stretches lobe 11 taut and in turn stretches lobe 12 taut around the outside of the shoe. The result is a smooth attractive covering for the outside of the shoe and a comfortable lining inside the shoe. The user may carry many alternate colors, fabrics, etc. of the shoe cover of this invention in minimum space and weight.

I claim:

1. For use with a shoe having a sole, a heel and an upper, including a toe area, an instep area and a heel area each having internal surfaces and external surfaces;

a cover for a shoe, comprising:

a pouch having a first lobe generally shaped to line the interior surfaces of a shoe, and a second lobe joined to said first lobe generally shaped to cover the external surfaces of a shoe, said pouch having an opening to receive the heel of a shoe and to permit insertion of the outer surface of the shoe into the second lobe of said pouch.

2. The cover of claim 1 wherein said pouch is completely closed except for said opening to receive a shoe heel, and said first lobe is continuously joined to said second lobe.

3. The cover of claim 2 wherein said pouch is formed of at least two pieces.

4. The cover of claim 3 wherein said pouch is formed of stretchable fabric.

5. For use with a shoe having a sole, a heel and an upper, including a toe area, an instep area and a heel area each having internal surfaces and external surfaces;

a cover for a shoe, comprising:

a single pouch having a first lobe generally shaped to line the interior surfaces of a shoe, and a second lobe joined to said first lobe and generally shaped to cover the external surfaces of a shoe, said pouch having an opening to receive the heel of a shoe and to permit insertion of the outer surface of the shoe into the second lobe of said pouch;

said pouch being completely closed except for said opening to receive a shoe heel, and said first lobe being continuously joined to said second lobe;

said pouch being formed of a single piece, said pouch having a seam extending from said opening along the part of said second lobe that covers the sole and the toe of a shoe, and further extending to the first lobe along the surface that covers the mid-line of the upper inside of a shoe, across the toe to the surface that covers the sole inside a shoe.

6. The cover of claim 5 wherein said pouch is formed of a single piece, said pouch having a seam extending from said opening along the part of said second lobe that covers the sole and the toe of a shoe, and extends to the first lobe along the mid-line of the upper inside of a shoe and across the toe to the sole inside a shoe.

7. The cover of claim 6 wherein a second seam extends from said opening across the portion of said pouch which covers the external surface of the heel of a shoe and the internal surface of the heel of a shoe.

8. The cover of claim 5 wherein the pouch is formed of a single piece, said pouch having a seam extending from said opening along the part of said second lobe that covers the sole and the toe of a shoe, and extends to the first lobe along the mid-line of the upper inside a shoe, across the toe to the sole inside a shoe.

9. The cover of claim 5 wherein said pouch has no visible seam except at the heel when said cover is on a shoe and said shoe is on a foot.

10. The cover of claim 5 wherein said pouch is formed of a single piece, said pouch having a seam extending from said opening along the part of said second lobe that covers the sole and the toe of a shoe then to the first lobe along the mid-line of the upper inside a shoe, across the toe to the sole inside a shoe and along the portion of the first lobe which covers the inner surface of the sole of a shoe, said seam forming a closed loop from the instep area upwardly around the margin of the upper within a shoe and back down to the instep area.

11. The cover of claim 10 wherein a second seam extends along the inside of the upper of a shoe to the toe of a shoe.

12. The cover of claim 6 wherein said pouch is formed of stretchable fabric.

* * * * *